US006050460A

United States Patent [19]

Licari et al.

[11] Patent Number: 6,050,460

[45] Date of Patent: Apr. 18, 2000

[54] FOLDING GARMENT HANGER

[76] Inventors: Vito Licari; Yafa Licari, both of 875 Ocean Ave., Elberon, N.J. 07740

[21] Appl. No.: 09/228,364

[22] Filed: Jan. 11, 1999

[51] Int. Cl.[7] ..... A47G 25/40

[52] U.S. Cl. ..... 223/94; 223/DIG. 4

[58] Field of Search ..... 223/85, 92, 94, 223/89, DIG. 4

[56] References Cited

U.S. PATENT DOCUMENTS

| | | | |
|---|---|---|---|
| 1,979,687 | 11/1934 | Hall | 223/94 |
| 2,409,269 | 10/1946 | Gersohn | 223/94 |
| 2,440,637 | 4/1948 | Lowe | 223/94 |
| 3,082,921 | 3/1963 | Sadowsky | 223/94 |
| 3,705,673 | 12/1972 | Mohammar | 223/94 |
| 5,397,037 | 3/1995 | Ozawa | 223/94 |
| 5,690,257 | 11/1997 | Ward | 223/94 |

*Primary Examiner*—Bibhu Mohanty
*Attorney, Agent, or Firm*—Mathews, Collins, Shepherd & Gould, P.A.

[57] ABSTRACT

A foldable garment hanger is disclosed that may be fabricated with two or three pieces that snap-fit together. The hanger comprises a first member, a second member, and a pivoting extension. Each member has an arm and a flange extending therefrom, and at least one of the members has a hook portion, and each member has a locking part. The pivoting extension protrudes from the flange of one member and snap-fits into an arcuate recess of the flange of the other member so that the flanges overlap and rotate relative to each other in a circular pattern. The locking parts then will hold the members in place in an unfolded configuration so that a garment may be hung on the extending arms of the hanger.

18 Claims, 6 Drawing Sheets

FOLDING GARMENT HANGER

FIELD OF THE INVENTION

The present invention relates to a foldable hanger which can be inserted into the neck of a garment when in a folded position and then unfolded to hang the garment. The hanger of this invention is a simple device that may be fabricated with two or three pieces that snap together.

BACKGROUND OF THE INVENTION

There have been many attempts to make folding hangers for clothes. Folding hangers are advantageous in that they may be collapsed to consume less space for storage or when traveling. Also, a folding hanger can be easier to use and pose less damage to garments. It can be inserted when in a folded position, into the neck of a sweater, dress, blouse, or the like, without having to undo any buttons or stretch the neck of the garment, and then the hanger can be unfolded to hang the garment. Folding hangers are described, for example, in the following U.S. Patents: U.S. Pat. No. 5,690,257 issued Nov. 25, 1997 to Ward; U.S. Pat. No. 5,590,823 issued Jan. 7, 1997 to Lunde; U.S. Pat. No. 5,397,037 issued Mar. 14, 1995 to Ozawa; U.S. Pat. No. 4,988,021 issued Jan. 29, 1991 to Adams et al.; U.S. Pat. No. 4,730,757 issued Mar. 15, 1988 to Keller; U.S. Pat. No. 4,186,857 issued Feb. 5, 1980 to Helms, Jr.; U.S. Pat. No. 3,802,610 issued Apr. 9, 1974 to Love; U.S. Pat. No. 3,082,921 issued Mar. 26, 1963 to Sadowsky; U.S. Pat. No. 2,724,533 issued Nov. 22, 1955 to Hansen; U.S. Pat. No. 2,448,523 issued Aug. 31, 1948 to Pandele; U.S. Pat. No. D263,013 issued Feb. 16, 1982 to Angeles; and U.S. Pat. No. D202,484 issued Oct. 5, 1965 to Helms, Jr.

There are drawbacks, however, with the folding hangers described in the abovereferenced patents. Many of the folding hangers involve complex designs with numerous interacting parts. The use of many parts makes it difficult to manufacture the hangers in a cost-effective manner for ordinary consumers, considering, particularly, that a hanger is a low-cost item. Additionally, complicated pivoting and latching mechanisms are used in the hangers of the above-cited patents, which increases the likelihood of product failure.

A hanger which is configured to provide a simpler design is shown in U.S. Pat. No. 5,690,257 to Ward ("Ward"). Ward describes a folding hanger which consists essentially of one integral piece having two movable halves or "wings" that pivot about one connection point and snap together with use of a tongue and groove latching mechanism. The Ward hanger places both a pivot means and a latching mechanism along a vertical surface disposed between the two wings, such that each of the wings has a vertical dimension, providing a relatively bulky hanger. Also, the two wings of the Ward hanger apparently are held in place (when in an unfolded configuration), entirely by the tongue and groove latching mechanism. Thus, if ordinary wear-and-tear were to erode the strength of the latching mechanism, the effectiveness of the hanger would be destroyed.

As may be appreciated, it would be advantageous to have a folding hanger that has a simple construction, is sturdy, is easy and low in cost to make, and allows for flexibility in design. New designs for folding hangers are desired to provide the consumer with a choice of products. The instant invention provides such a folding hanger. Further advantages may appear more fully upon considering the description given below.

SUMMARY OF THE INVENTION

Summarily described, the invention embraces a foldable garment hanger that comprises essentially two or three pieces that may be snap-fit together. The hanger comprises a first member, a second member, and a pivoting extension. The pivoting extension may be integrally formed on one member to provide a hanger comprising two pieces that can be interconnected. Each member comprises an elongated arm having a first end and a second end, and a flange extending therefrom. The members are pivotally joined together at the flanges with the pivoting extension. At least one and preferably both of the members has a hook portion extending upward from the arm for suspending the hanger on a fixed surface. Each member has a locking part that corresponds to the locking part of the other member.

The pivoting extension is either integrally formed on one flange or snap-fits therein. The pivoting extension in either case extends outward from the flange of one member (the first member), and it is dimensioned to snap-fit into a recess in the flange of the other member (the second member) so that the second member may circularly rotate about the flange of the first member. Also, the locking parts of the first and second members define a locking mechanism movable between a locked and an unlocked position. When the locking mechanism is in a locked position, the first and second members may be maintained in a substantially set position to define an unfolded hanger for hanging the garment. When the locking mechanism is in an unlocked position, the first and second members may pivot about the pivoting extension to define the hanger in a folded configuration.

BRIEF DESCRIPTION OF THE DRAWINGS

For a better understanding of the invention, an exemplary embodiment is described below, considered together with the accompanying drawings, in which.

It is to be understood that these drawings are for the purposes of illustrating the concepts of the invention and are not to scale.

DETAILED DESCRIPTION OF THE INVENTION

Figures 1, 1A, 1B:
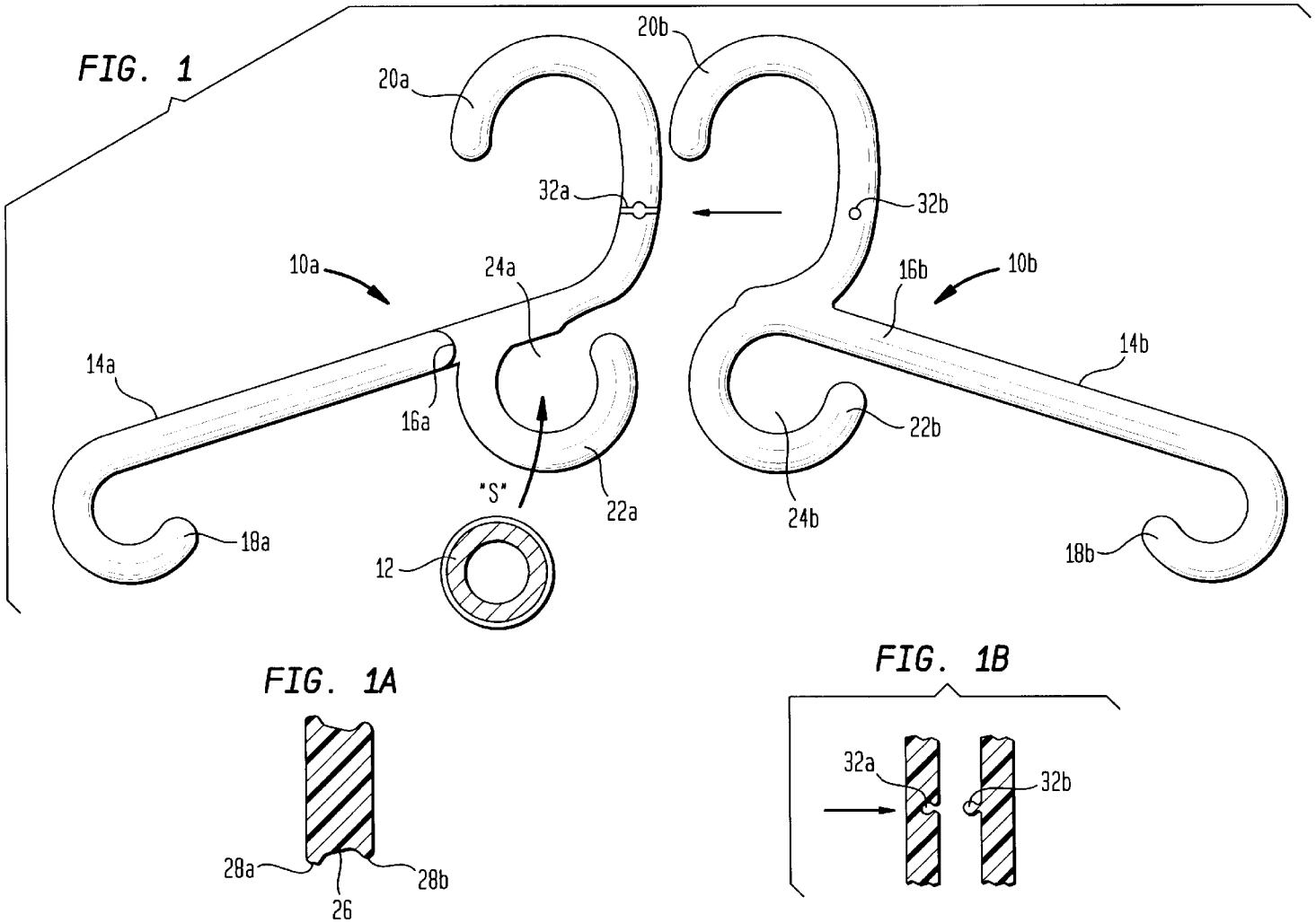
FIG. 1 illustrates one embodiment of the inventive hanger in a disassembled configuration.
FIG. 1A illustrates a side view of the pivoting extension of FIG. 1 comprising a pivoting ring.
FIG. 1B illustrates a side view of the locking mechanism of FIG. 1.

Referring to FIG. 1A, the hanger is shown disassembled as having three pieces that may be snap-fit together, i.e., a first member 10*a*, a second member 10*b*, and a pivoting extension 12. The pivoting extension projects from one of the members and cooperates with a recess of the other member so that the two members may rotate in a circular pattern, and in this embodiment, the extension is shown with hatching comprising a pivoting ring. Each member 10*a*, 10*b*, has an arm 14*a*, 14*b*, respectively. Each arm has a first end and a second end, i.e., the arm 14*a* of the first member 10*a* has first end 16*a* and second end 18*a*, and the arm 14*b* of the second member 10*b* has first end 16*b* and second end 18*b*. Preferably, each arm is tubular in its cross-sectional shape. A hook portion 20*a*, 20*b*, is shown extending upwardly from one end of each arm (e.g., 16*a*, 16*b*, respectively); it is preferred that each member 10*a*, 10*b* have a hook portion, although the hanger would work were the hook portion disposed only on one member.

A flange 22*a*, 22*b*, extends downward from each arm proximal the first end 16*a*, 16*b*. The flanges 22*a*, 22*b*, are configured so that the pivoting extension 12 may project from one flange (e.g., 22*a*) and is dimensioned to snap-fit into an arcuate or substantially annular recess 24*b* of the other flange (22*b*). For example, in FIG. 1, the pivoting extension comprises a pivoting ring, a side view of which is shown in FIG. 1A. The ring snap-fits into one flange, e.g., 22*a*, following arrow "s" of FIG. 1. The width of the ring is greater than the width of the flange so that when the ring is held in one flange (e.g., 22*a*), it projects outward from the surface thereof similar to the configuration of FIG. 2B, which shows an integrally formed pivoting ring. The other flange (e.g., 22*b* of FIG. 1 and 22*a* of FIG. 2B) is then pressed over the projecting ring (e.g., following arrow "p" of FIG. 2B), so that the two members are coupled together.

Figure 4A:
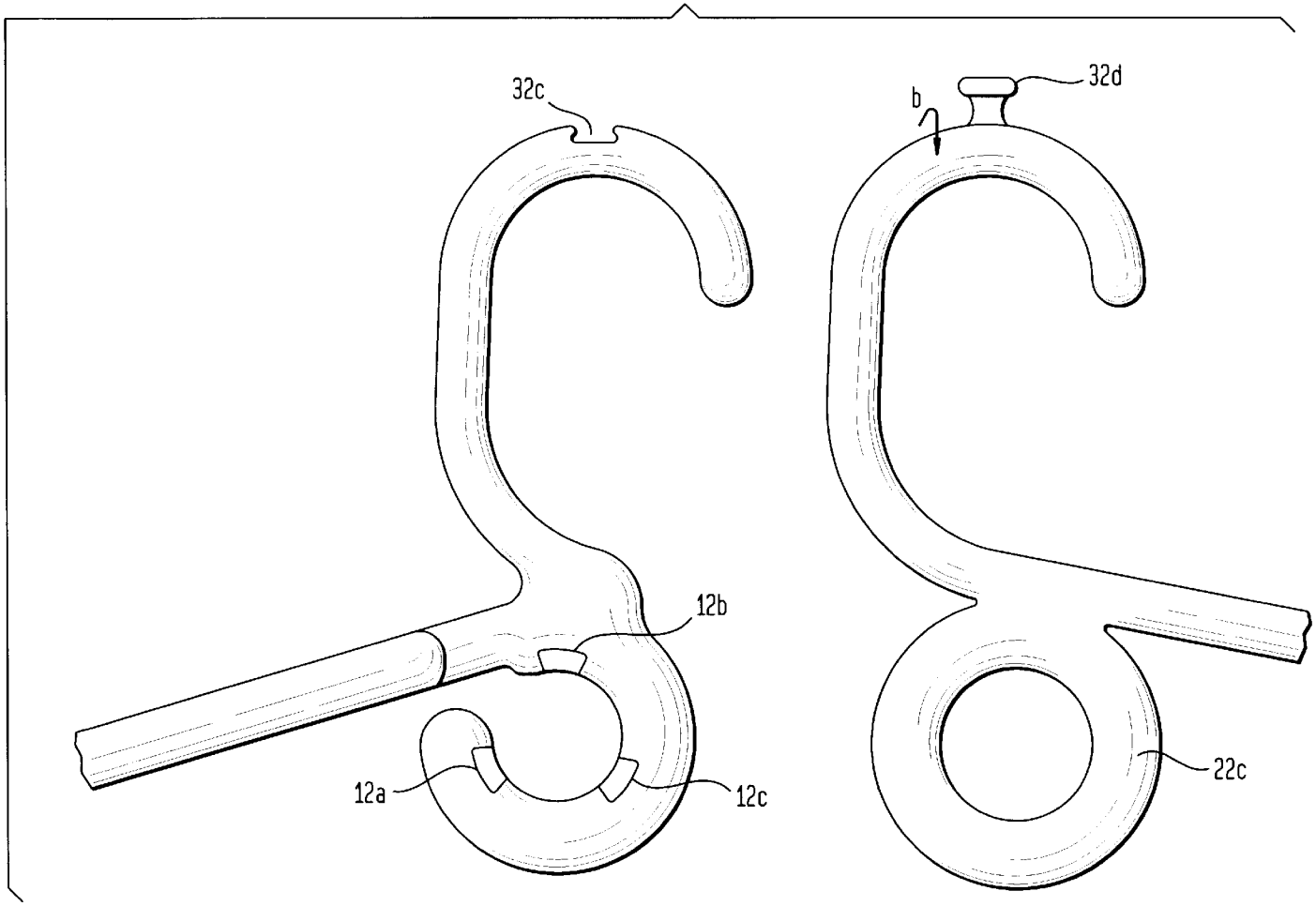
FIG. 4A illustrates a view of an alternative embodiment of the inventive hanger in a disassembled configuration with the ends of the arms hidden from view.

To accomplish the snap-fit where the pivoting ring is used, advantageously the outer side surface of the ring has around its circumference a depressed channel 26 and ridges 28*a*, 28*b* on either side of the channel, as shown in FIG. 1A The flanges in the embodiment FIG. 1 comprise substantially circular bands 22*a*, 22*b*, each having an inner bore 24*a*, 24*b*, the term "substantially" meaning the bands may be configured in a circular pattern completing less than 360° of the circle though greater than 180°. The bands may of course form complete circles 360° as well, as shown in FIG. 4A (e.g., flange 22*c*). It is also contemplated that the flanges may be arranged along a circular outline without necessarily forming a substantially circular band, for example, each of the flanges may comprise an arc (e.g., 22*d* and 22*e* of FIG. 4B), so that when flange is placed against the other flange, the two flanges may rotate about a circular pattern.

Figure 2:
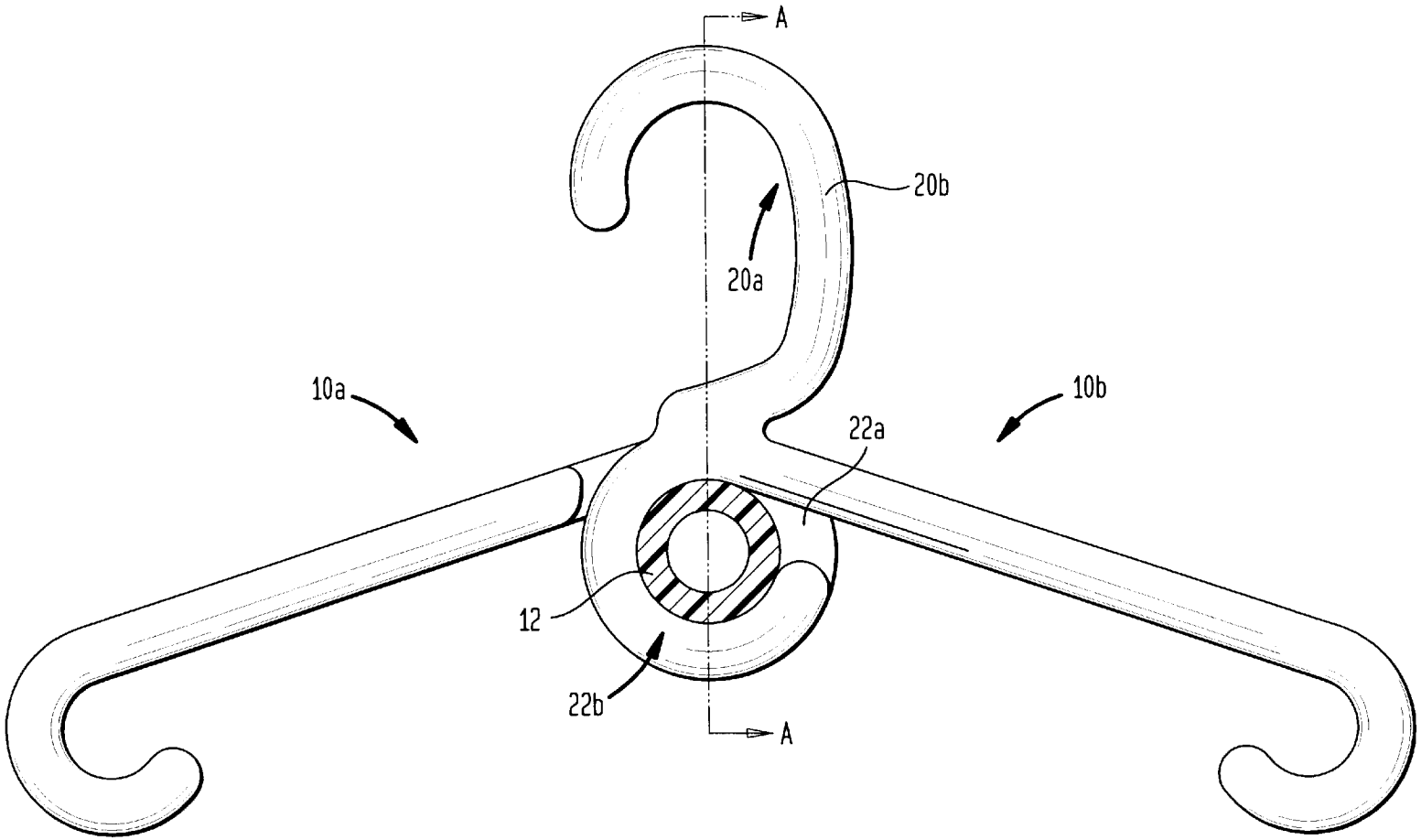
FIG. 2 illustrates the hanger of FIG. 1 in an assembled configuration.
Figure 2A:
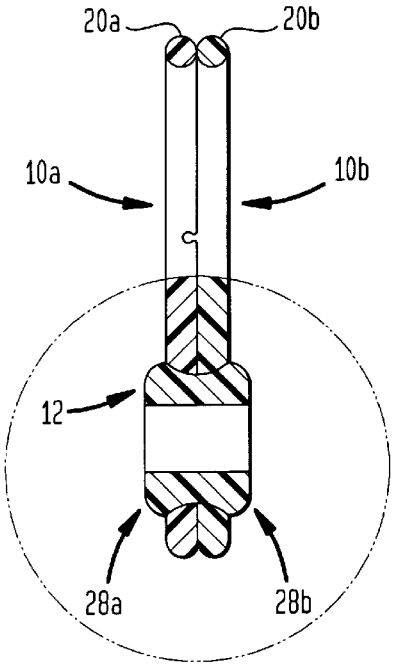
FIG. 2A illustrates a cross-sectional side view of the hanger of FIG. 1 in an assembled configuration taken along the line A—A of FIG. 2.

In any case, in the embodiment where substantially circular bands are used, as in FIG. 1 and 2A, the pivoting ring snap-fits into the inner bore of both the flanges. The channel 26 of the ring sits within the bands, and the ridges 28*a*, 28*b*, protrude from the sides of the bands to hold the members together within the channel. The assembly of the hanger of FIG. 1, once the snap-fit is accomplished, is illustrated in FIG. 2. As can be seen, the pivoting ring 12 has been placed into the flange 22*a* of the first member 10*a*, and the flange 22*b* of the second member has been over the flange of the first member to snap-fit over the pivoting ring 12. The hook portions 20*a*, 20*b*, of both the first and second members overlap to define one hook. The second member 10*b* may circularly rotate about the flange of the first member. In this embodiment, the rotation of the second member 10*b* is achieved with the flange 22*b* of the second member swiveling on the pivoting ring projecting from the first flange 22*a*.

Figure 3:
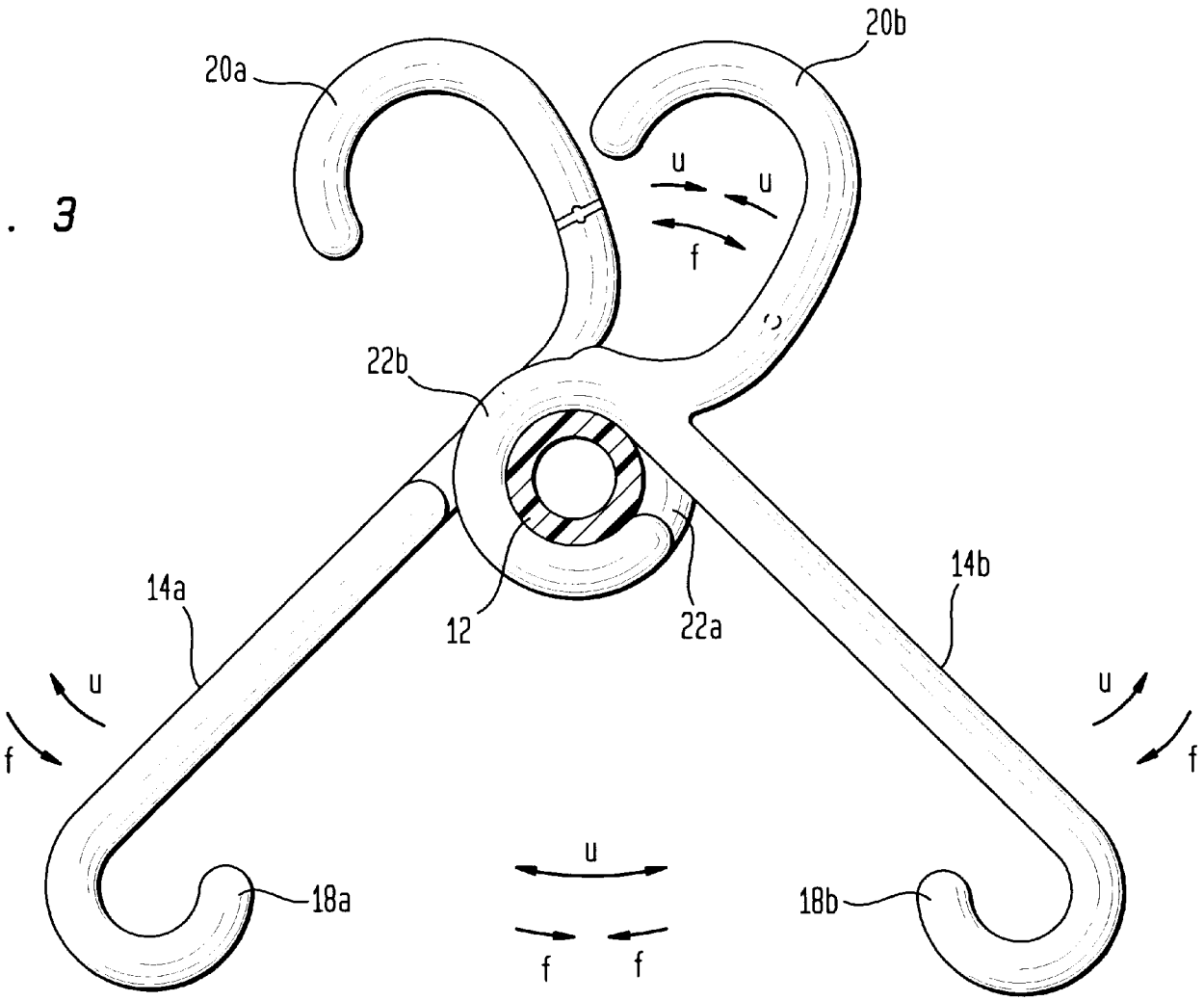
FIG. 3 illustrates operation of one embodiment of the inventive hanger as assembled.

FIG. 3 illustrates operation of the device. With the rotation of the members, the hook portions 20*a*, 20*b* may be pulled and separated apart, such that the arms 14*a*, 14*b*, will approach each other, following arrows "f". Once folded, the hanger may be inserted into a collar or neck of a top, without having to unbutton the shirt or otherwise stretch the neck of the garment. Advantageously, the second ends 18*a*, 18*b*, of the arms are curved inwardly toward the first ends 16*a*, 16*b*, which aids in inserting the hanger in a garment, and also may serve the additional function of a garment strap hook. Once the hanger is inserted, it can be unfolded following arrows "u" of FIG. 3; the members can be pivoted about the ring so that the arms are brought upward toward a horizontal position, and the hook portions are brought toward each other to be joined. Ultimately, the hooks are again overlapping, as in FIG. 2, and the garment may be hung, e.g. on a fixed surface such as a closet rod or hook.

Figure 2B:
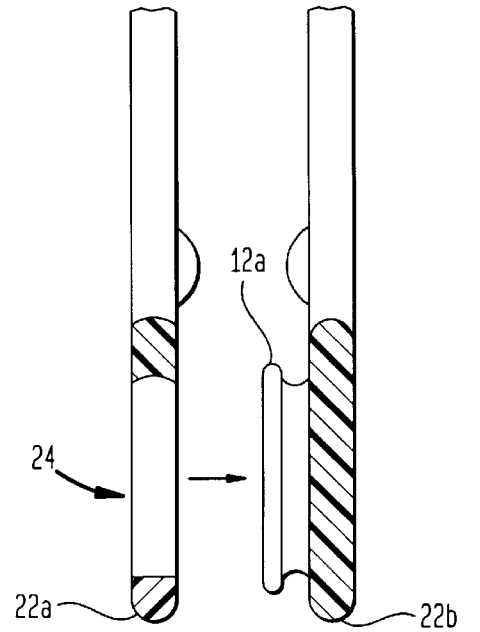
FIG. 2B illustrates a cut-away view of an alternative embodiment of the hanger at the boxed region B—B of FIG. 2A where the pivoting extension is integrally formed in one of the two members.
Figure 2C:
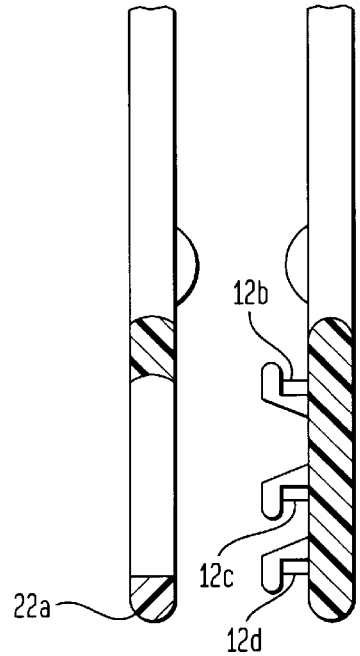
FIG. 2C illustrates a cut-away view of an alternative embodiment of the hanger at the boxed region B—B of FIG. 2A where the pivoting extension comprises a plurality of projections arranged in a circular pattern.

The snap-fitting of the extension 12 into the recess 24 is also shown with reference to FIGS. 2A–2C. FIG. 2A illustrates a cross-sectional side view of the hanger of FIG. 1 in an assembled configuration taken along the line A—A of FIG. 2. As can be seen, the ring 12 is snap-fit through the flange of both members 10*a*, 10*b*; the ridges 28*a*, 28*b*, of the ring hold the members 10*a*, 10*b* together, with the members sitting within the channel 26 (FIG. 1A). FIG. 2B illustrates a cut-away view of an alternative embodiment of the hanger at the boxed region B—B of FIG. 2A where the pivoting extension is integrally formed in the second member 22*b*. This embodiment is advantageous in that the foldable hanger may be fabricated to comprise two connectable pieces, e.g., the first member and the second member. FIG. 2C illustrates a cut-away view of an alternative embodiment of the hanger at the boxed region B—B of FIG. 2A where the pivoting extension comprises a plurality of projections 12*b*, 12*c*, 12*d*, arranged in a circular pattern. Essentially, the projections 12*b*, 12*c*, 12*d*, are analogous to an integral ring 12a, which has been partially truncated. A front view of an embodiment involving a plurality of projections 12*b*, 12*c*, 12*d*, is shown in FIG. 4A. These projections may be fingerlike in shape, as shown in FIG. 2C, so that the tips of the projections can "catch" or latch onto the flange of the other member (22*a* in FIG. 2C). This embodiment is advantageous in that less raw materials need to be used to fabricate the hanger.

Referring now back to FIG. 1, a locking mechanism comprising a first part 32*a*, and a second part 32*b*, are disposed on the first and second members. The parts are disposed at corresponding locations of the members, as also shown in FIGS. 1B and 4A. When the mechanism is in a locked position, the first and second members may be maintained in a substantially set position to define the unfolded hanger for hanging the garment, as shown in FIG. 2. When the mechanism is in an unlocked position, the first and second members are released so that they may pivot to define the hanger in a folded configuration, as shown in FIG. 3. Advantageously, the first part 32*a* of the locking mechanism is disposed on the hook portion 20*a* of the first member, and the second part 32*b* of the locking mechanism is disposed on the hook portion 20*b* of the second member. However, where only one hook portion is used, the locking mechanism may be disposed on the arms of the first and second members 14*a*, 14*b*, adjacent the flanges 22*a*, 22*b* (not shown). The locking mechanism comprises one locking part 32*a* defining an indentation such as a channel or groove, and the other locking part 32*b* comprising a protrusion that is dimensioned to snap fit into the indentation. For example, in FIG. 1B, the indentation comprises a channel having a recess therein 32*a*, and the protrusion is configured as having a bulbous tip 32*b* for snap-fitting into the recess of the channel. In FIG. 4A, the indentation comprises a groove 32*c*, and the protrusion comprises a tongue-like flap 32*d* configured to bend at its narrow section, following arrow "b" of FIG. 4A, to fold into the groove.

Figure 4B:
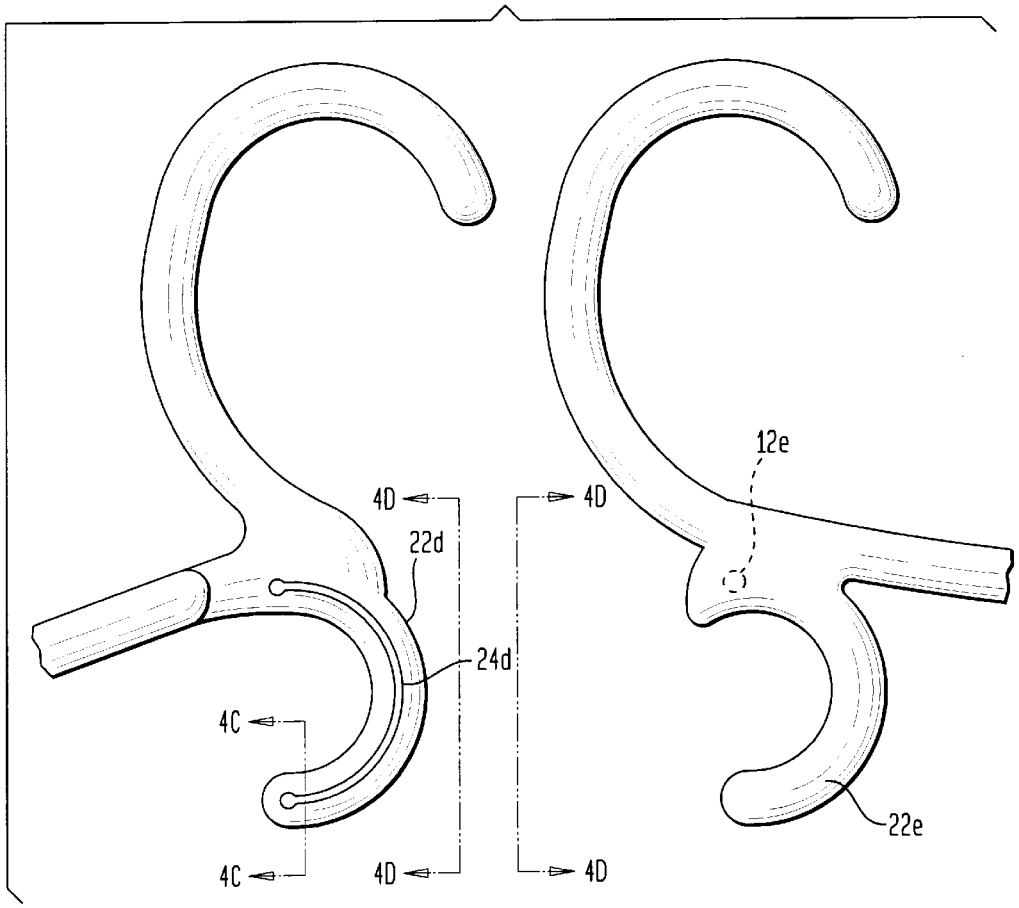
FIG. 4B illustrates another alternative embodiment of the inventive hanger in a disassembled configuration with the ends of the arms hidden from view.
Figure 4C:
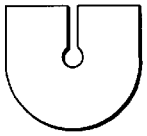
FIG. 4C illustrates a cross-sectional side view of the flange of FIG. 4B taken along the line C—C of FIG. 4B.
Figure 4D:
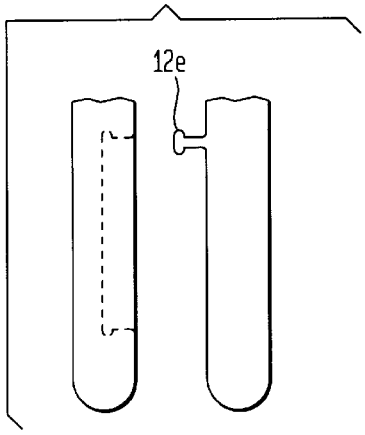
FIG. 4D illustrates a cut-away side view of the hanger of FIG. 4B in a disassembled configuration taken along the lines D—D of FIG. 4B.

Preferably, the first and second arms have a tubular shape. When the hanger is assembled (e.g., as in FIG. 2), the first and second hook portions are placed flush against each other and overlap, which also is the case for the first and second flanges 22*a*, 22*b*. The tubular arms 14*a*, 14*b*, do not overlap but instead extend outwardly. Thus, while the arms are preferably tubular, the hook portions and flanges preferably each are of a truncated tubular shape. In this way, the complete hanger as assembled will be tubular. These shapes are illustrated in FIGS. 1, 4A, and 4B. For example, the solid white portions of the members are tubular, and the portions of the members shaded with cross-hatching are truncated tubular. (The truncated underside of the hook portions and flanges 22*b*, 22*c*, 22*e* in FIGS. 1, 4A and 4B are hidden from view). When the first hook portion 20*a* and the first flange 22*a* are placed against the second hook portion 20*b* and the second flange 22*b* (or 22*c*, 22*e*), the hook portions and the flanges form a tubular shape. Advantageously, the hanger is fabricated with from plastic, e.g., polyethylene, polypropylene, styrene, nylon, and copolymers, but it also could be fabricated from other materials such as metals or woods.

It is understood that the embodiments described herein are merely exemplary and that a person skilled in the art may make variations and modifications without departing from the spirit and scope of the invention. All such variations and modifications are intended to be included within the scope of the appended claims.

We claim:

1. A foldable hanger comprising:

a first member and a second member, the first and second members each having an elongated arm for extending in a garment, each arm having a first end and a second end, a substantially circular flange extending downward from the first end of each arm to define a first flange extending from the first end of the first member and a second flange extending from the first end of the second member, the first flange having at least one pivoting extension projecting therefrom and the second flange having an arcuate recess for receiving the at least one pivoting extension, the at least one pivoting extension being dimensioned with a tip so that the at least one pivoting extension will snap-fit through the recess to couple the first and second members together and simultaneously enable at least one of the first and second members to circularly rotate relative to the other member, at least one of the members having a hook portion extending upward from the arm;

a locking mechanism comprising a first part and a second part disposed on the first and second members, respectively, so that when the mechanism is in a locked position, the first and second members may be maintained in a substantially set position to define an unfolded hanger for hanging the garment, and when the mechanism is in an unlocked position, the first and second members may pivot to define the hanger in a folded configuration.

2. The hanger of claim 1, in which the first and second flanges and the first and second parts of the locking mechanism are integrally formed on the first and second members, respectively, and the hook portion is integrally formed in the at least one member so that the hanger comprises no more than three connectable pieces when disassembled consisting of the first member, the second member, and the at least one pivoting extension.

3. The hanger of claim 2, in which the pivoting extension is integrally formed in the first member so that the hanger when disassembled comprises no more than two connectable pieces.

4. The hanger of claim 2 fabricated with plastic.

5. The hanger of claim 1, in which the first and second flanges each comprise a substantially circular band, each band having an inner bore, and the pivoting extension comprises a ring configured to snap-fit into the inner bore of at least one of the first and second flanges.

6. The hanger of claim 5, in which the ring is integrally formed in the first member and snap-fits into the inner bore defined by the band of the second member.

7. A foldable hanger comprising:

a first member and a second member, the first and second members each having an elongated arm for extending in a garment, each arm having a first end, a second end, and a flange extending from one end, the flanges defining a first flange extending from the first member and a second flange extending from the second member, in which the first and second flanges are disposed at the first ends of the arms of the first and second members, respectively, and the first and second members each has a hook portion extending upward from the first end of each arm to define a first hook portion and a second hook portion, respectively, the first flange having a pivoting extension projecting therefrom and the second flange having an arcuate recess for receiving the pivoting extension, the pivoting extension and the recess being dimensioned so that the pivoting extension may snap-fit into the recess and the flange of at least one of the first and second members may circularly rotate relative to the flange of the other member, wherein the first and second members may be rotated about the pivoting extension between an unfolded configuration with the first hook portion overlapping the second hook portion and a folded configuration with the first hook portion being separated from the second hook portion.

8. The hanger of claim 7, further comprising a locking mechanism having a first part and a second part disposed on the first and second members, respectively, in which the first part of the locking mechanism is disposed on the first hook portion and the second part of the locking mechanism is disposed on the second hook portion.

9. A foldable hanger comprising:

a first member and a second member, the first and second members each having an elongated arm for extending in a garment, each arm having a first end, a second end, a flange extending from one end, and a hook portion extending upward from the first end of each arm to define a first hook portion and a second hook portion, respectively, in which the first and second arms are tubular in shape; and the first and second hook portions and the first and second flanges are of a truncated tubular shape so that when the first hook portion and the first flange are placed against the second hook portion and the second flange, the hook portions and the flanges form a tubular shape;

the first flange having a pivoting extension projecting therefrom and the second flange having an arcuate recess for receiving the pivoting extension, the pivoting extension and the recess being dimensioned so that the pivoting extension may snap-fit into the recess and the flange of at least one of the first and second members may circularly rotate relative to the flange of the other member, wherein the first and second members may be rotated about the pivoting extension between an unfolded configuration with the first hook portion overlapping the second hook portion and a folded configuration with the first hook portion being separated from the second hook portion.

10. The hanger of claim 9 fabricated with plastic.

11. The hanger of claim 7, in which the pivoting extension comprises a plurality of elongated fingerlike projections extending along a plane substantially perpendicular to the first flange and arranged in a circular pattern, the projections each having a tip at its free end extending away from the plane for snap-fitting over the second flange.

12. A foldable garment hanger comprising a first member and a second member that may be snap-fit together, (a) the first and second members each comprising:

an elongated arm having a first end and a second end, a hook portion extending upward from the first end of the arm, and a substantially circular ring having an inner bore extending downward from the first end of each arm, (b) wherein the ring of the first member has a pivoting extension projecting therefrom in a circular pattern, the pivoting extension being dimensioned with an outwardly extending tip so that it will snap-fit into the bore of the ring of the second member, whereby the pivoting extension may move in a circular pattern within the recess so that the first and second members may be rotated relative to each other from a first position to a second position whereby when in the first position, the first and second members define an unfolded hanger for hanging a garment and in the second position the first and second members define a folded hanger for insertion into the neck of a garment.

13. The hanger of claim 12, in which the arm, the hook portion, and the ring of each of the first and second members are each integrally formed on the first and second members so that the first and second members define a foldable hanger consisting of when disassembled three connectable pieces.

14. The hanger of claim 13, in which the pivoting extension is integrally formed on the ring of the first member to define a foldable hanger consisting of two connectable pieces when disassembled.

15. The hanger of claim 12, in which the locking part of one member comprises an indentation and the locking part of the other member comprises a protrusion configured to snap-fit into the indentation.

16. The hanger of claim 15, in which the indentation comprises a groove and the protrusion comprises a tongue-like flap configured to fold into the groove.

17. The hanger of claim 15, in which the indentation comprises a channel having a recess therein and the protrusion has a bulbous tip configured to snap-fit into the recess of the channel.

18. A two-piece plastic foldable hanger for hanging a garment comprising a first member and a second member that may be snap-fit together, (a) the first and second members each have integrally formed thereon, (i) an elongated arm having a first end and a second end, (ii) a hook portion extending upward from the first end of the arm, (iii) a substantially circular band having an inner bore extending downward from the first end of the arm, and (iv) a locking part, (b) wherein, (i) the band of the first member has a pivoting extension integrally formed thereon and projecting therefrom in a circular pattern, the pivoting extension being dimensioned to snap-fit into the bore of the band of the second member so that the second member may circularly rotate around the pivoting extension of the first member, (ii) the locking part defining a locking mechanism movable between a locked and an unlocked position, such that when the mechanism is in a locked position, the first and second members may be maintained in a substantially set position to define an unfolded hanger for hanging the garment, and when in an unlocked position, the first and second members may pivot to define the hanger in a folded configuration, and (iii) the arm of each of the first and second member is tubular in shape; and the hook portions and the bands of each of the first and second members are of a truncated tubular shape so that when the hook portion and the band of the first member are placed flush against the hook portion and the band of the second member, the first and second members define a tubular hanger.

* * * * *